US009726179B2

(12) United States Patent
Dumonceaux

(10) Patent No.: US 9,726,179 B2
(45) Date of Patent: Aug. 8, 2017

(54) WASTEWATER PUMP

(71) Applicant: Société d'implantation et de diffusion d'équipements électro-hydrauliques (S.I.D.E), Villemer (FR)

(72) Inventor: Stephané Dumonceaux, Burcy (FR)

(73) Assignee: Societe D'Implantation Et De Diffusion D'Equipements Electro-Hydrauliques (S.I.D.E), Villemer (FR)

( * ) Notice: Subject to any disclaimer, the term of this patent is extended or adjusted under 35 U.S.C. 154(b) by 460 days.

(21) Appl. No.: 14/333,711

(22) Filed: Jul. 17, 2014

(65) Prior Publication Data

US 2015/0023783 A1 Jan. 22, 2015

(30) Foreign Application Priority Data

Jul. 17, 2013 (FR) ..... 1355537

(51) Int. Cl.
*F04D 13/06* (2006.01)
*F04D 29/22* (2006.01)
*F04D 7/04* (2006.01)

(52) U.S. Cl.
CPC ..... *F04D 7/045* (2013.01); *F04D 13/06* (2013.01); *F04D 29/2283* (2013.01); *F04D 29/2288* (2013.01)

(58) Field of Classification Search
CPC .. F04D 7/045; F04D 29/2283; F04D 29/2288; F04D 13/06; B02C 18/0084; B02C 18/0092
USPC ..... 415/121.1, 121.2; 416/131, 142, 143
See application file for complete search history.

(56) References Cited

U.S. PATENT DOCUMENTS 3,096,718 A * 7/1963 Anderson ..... B02C 18/0092 241/185.6
2010/0310378 A1* 12/2010 Kalavsky ..... F04D 15/0055 416/223 R

* cited by examiner

*Primary Examiner* — Dwayne J White
*Assistant Examiner* — Peter T Hrubiec
(74) *Attorney, Agent, or Firm* — Drinker Biddle & Reath LLP

(57) ABSTRACT

Wastewater pump comprising a reversible motor (110) driving a rotor (160) equipped with blades (170).
The rotor (160) is a disc (165) bearing pivoting blades (170) each mounted on a radial spindle (167) borne by the rotor. Each blade (170) is composed of a plate (171) bearing an articulation node (175) engaged on the spindle and a cutter (172) on the back of the plate forming a prop supporting the plate in the active position when the rotor (160) is rotating in the forward direction (D), and the cutter (172) projecting in the peripheral direction when the rotor (160) turns in the reverse direction (R), the plate (171) being applied against the disc (165). A fixed ring surrounds the disc and bears at least one cutter (135).

8 Claims, 6 Drawing Sheets

WASTEWATER PUMP

FIELD OF THE INVENTION

Figure 1:
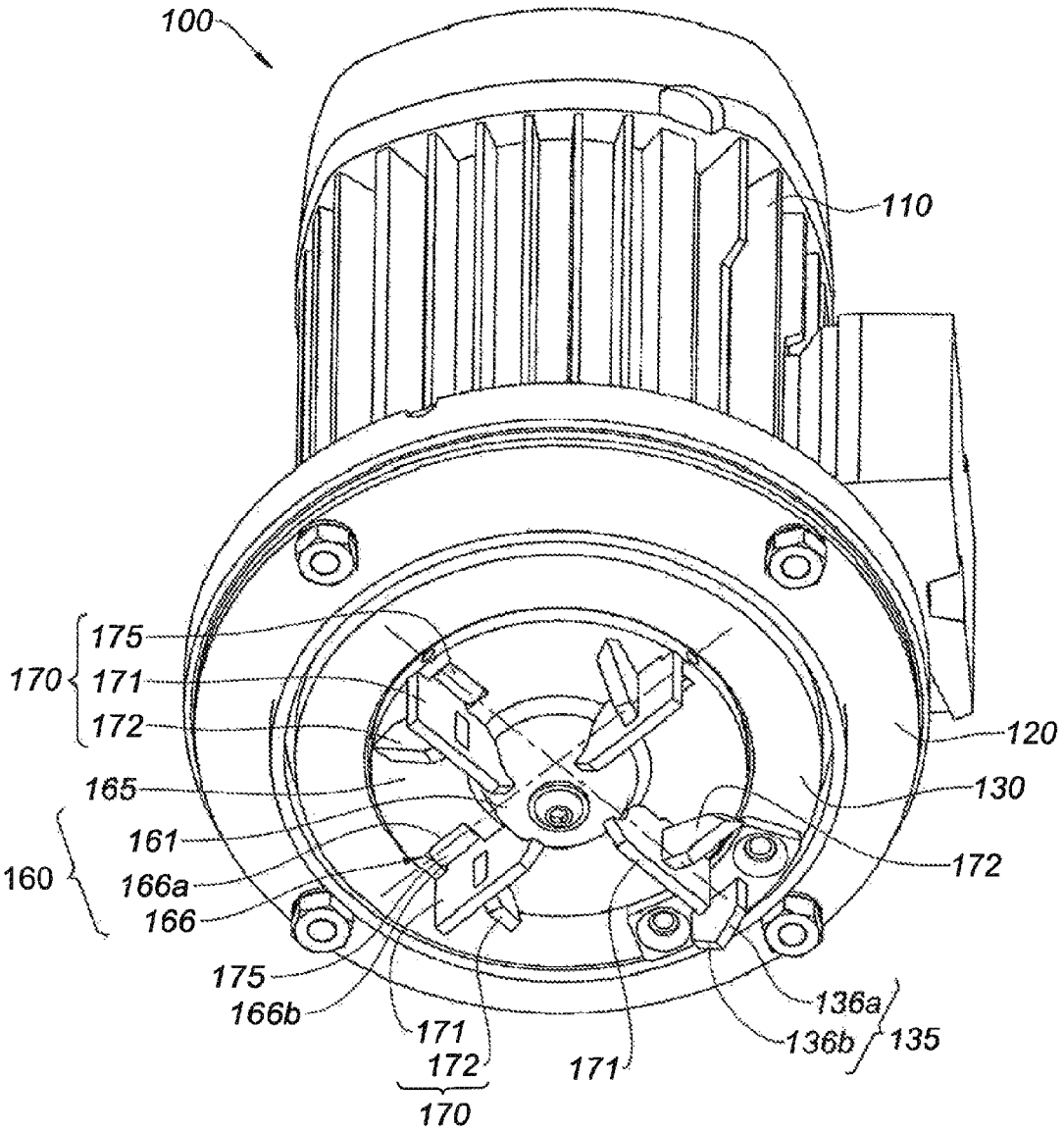

The present invention relates to a wastewater pump comprising a reversible motor driving a rotor equipped with blades, housed in a pump chamber with an axial inlet and tangential outlet.

PRIOR ART

There are numerous types of pumps for wastewater or water laden with suspended solids, which pumps are intended to tackle the difficulties of clogging of the rotor by products which become wound around the blades.

It is likewise generally known to equip such pumps with reversible motors, generally electric motors, in such a way as to be able to free the tangle of products surrounding the blades of the rotor which usually turn in the forward direction, that is to say in the direction of pumping of the fluid. However, the reversibility of the rotor does not always enable unclogging of the pump chamber so that it is necessary to remove the pump or the cover of the chamber in order to clean the rotor.

A pump is likewise known which is equipped with a shear system approaching the blades with fixed cutters in order to shear the thread-like elements conveyed by the wastewater. However, it has been shown in practice that this type of system requires a clearance which is impossible to maintain over time for the pumping of effluents containing sand, which is generally the case, so that this shear system only has a very limited effectiveness over time. When the effectiveness of the shear disappears, the drawbacks of the known pumps are apparent, that is to say the reduction in the fluid output of the pump or the over-consumption of energy. In all cases, the motor of the known pump must be oversized although that does not solve all the problems.

OBJECT OF THE INVENTION

The object of the present invention is to develop a wastewater pump which enables easy release or unclogging of the rotor clogged with stringy materials or fibres without the need for a fragile shear system, nor for a powerful motor in order to guarantee a constant hydraulic output, without resulting in an over-consumption of energy.

DISCLOSURE AND ADVANTAGES OF THE INVENTION

To this end, the present invention relates to a wastewater pump of the type defined above, characterised in that the rotor is a disc bearing blades each mounted on a radial spindle borne by the rotor and pivoting between an active position raised in the forward direction of rotation of the rotor and a position retracted against the disc for the reverse direction of rotation of the rotor, each blade being composed of a plate bearing an articulation node engaged on the spindle and a cutter on the back of the plate forming a prop supporting the plate in the active position when the rotor is rotating in the forward direction, and the cutter projecting in the peripheral direction when the rotor turns in the reverse direction, the plate being applied against the disc, a fixed ring surrounding the disc and bearing at least one cutter.

The pump according to the invention has the advantage that it makes it possible easily and quickly to release the rotor clogged with fabrics and stringy materials and without being sensitive to the abrasion of the sand entrained by the wastewater. It is sufficient to make the pump turn for a few moments in the reverse direction in order to cut all the thread-like elements, fabrics and tangles which clog the chamber of the rotor. In addition, as the blades are practically retracted, the backflow of liquid in the reverse direction is negligible. The pump according to the invention is particularly resistant to such wastewater laden with sand since it does not require compliance with a strict clearance. By virtue of the effectiveness of the untangling of the rotor, the pump retains all of its hydraulic effectiveness without the need for a powerful motor or involving an over-consumption of energy following the clogging of the rotor.

The shredding of clogging products by the rotor also facilitates the water treatment downstream of the pump.

According to another advantageous characteristic, the disc of the rotor includes windows housing the articulation spindles of the plates and each receiving the node of a plate. This embodiment of the rotor is particularly simple because the spindles are engaged in bearings at the two ends of each window between the inner radial end and the outer radial end; the node of each plate is retracted in the window, which reduces clogging or the relief on the top of the disc when the blade is in the active position; this also facilitates the retraction of the plate of each blade in the lowered position.

In this context and in a particularly advantageous manner, the articulation node extends over the centre of the edge of the plate, the node being offset in relation to the plane of the plate so that this latter comes to be flat on the disc when it is in the lowered position.

In this context and in a particularly advantageous manner, the node and its window are dimensioned so that in the raised position and in the lowered position the node is supported against the respective downstream edge of the window in the direction of rotation of the rotor.

This combination of the dimension of the node and of the window makes it possible to ensure an excellent support of the blade both in the raised position and in the lowered position, when in this latter position the blade receives the forces exerted on the prop functioning as cutter.

According to another advantageous characteristic, the radial length of the window and of its spindle in the window is equal to the radial length of the node, except for the clearance.

This dimensional consistency between the radial length of the node and the radial length of the window enables an excellent support of the blade in the radial direction avoiding the local deformations of the spindle and of the supporting face (exterior face) of the window under the effect of the rotation of the rotor.

In addition, as the pivoting movement of the blades is performed on startup when the direction of rotation is reversed (from the forward direction to the reverse direction or vice versa), the friction generated by the movement of the blade on the radially exterior face of the window is particularly limited whilst at full power the blade is immobile with respect to the window.

According to another advantageous characteristic, the disc includes a hub in relief and the edge of each blade plate follows the profile of the hub when the plate is in the active position. This shape of the disc with its hub ensures good stability of the hub on the end of the motor shaft and is rounded in order to offer the least possible hold for the thread-like objects with which the wastewater is laden.

According to another advantageous characteristic, the cutter fixed to the back of the plate of a blade has a subdivided edge forming the cutting edge, with a first edge segment on the plate side, at the base of the tooth followed by an inclined edge segment joining the top in the form of the tip of the cutter. This forms of edge, in particular a subdivided cutting edge, favours the effect of cutting out and release of the fibrous materials surrounding the rotor as applicable.

DRAWINGS

Figure 2:
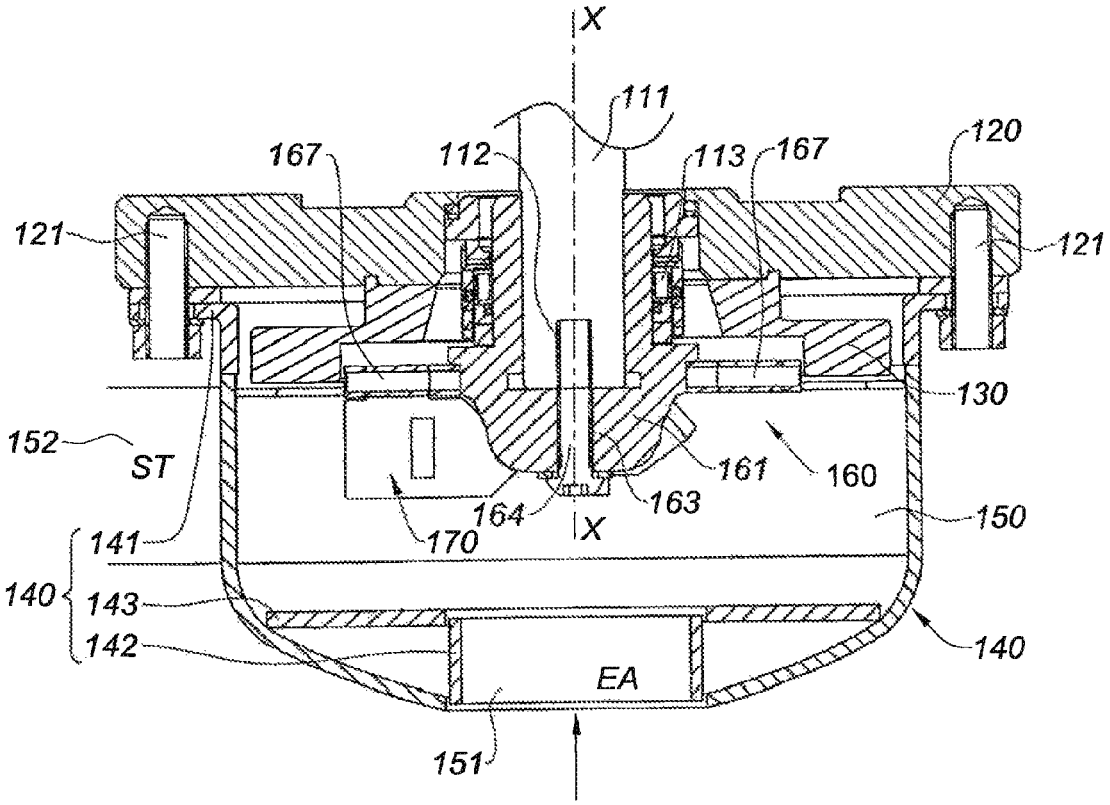
Figure 3:
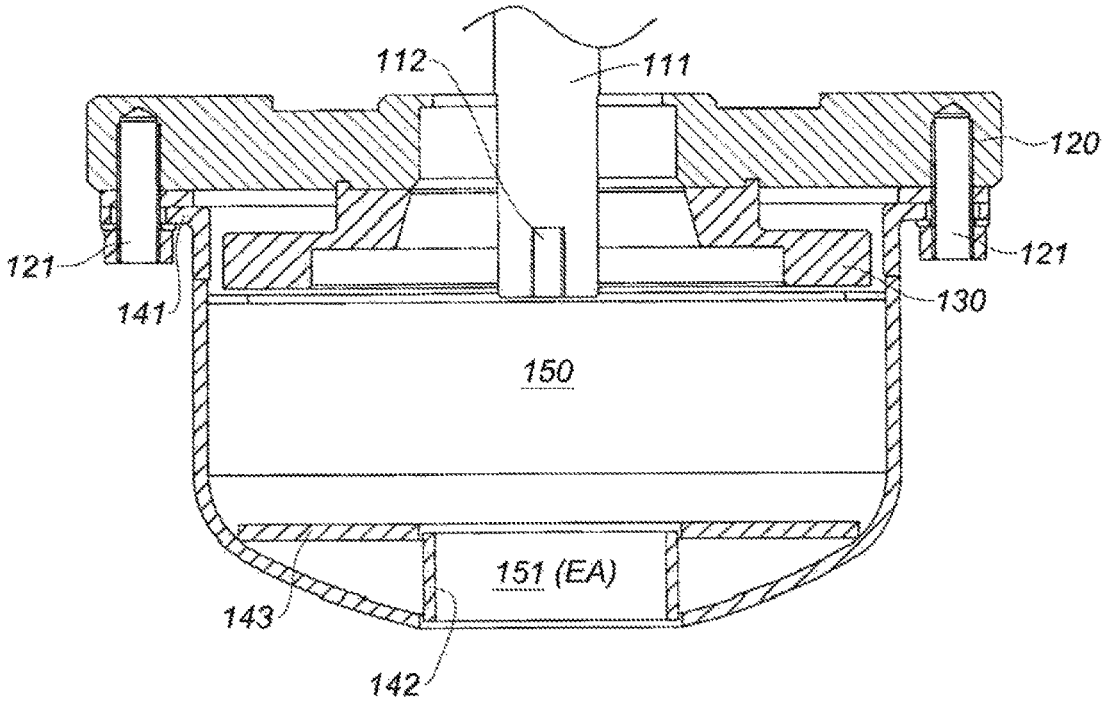
Figure 4:
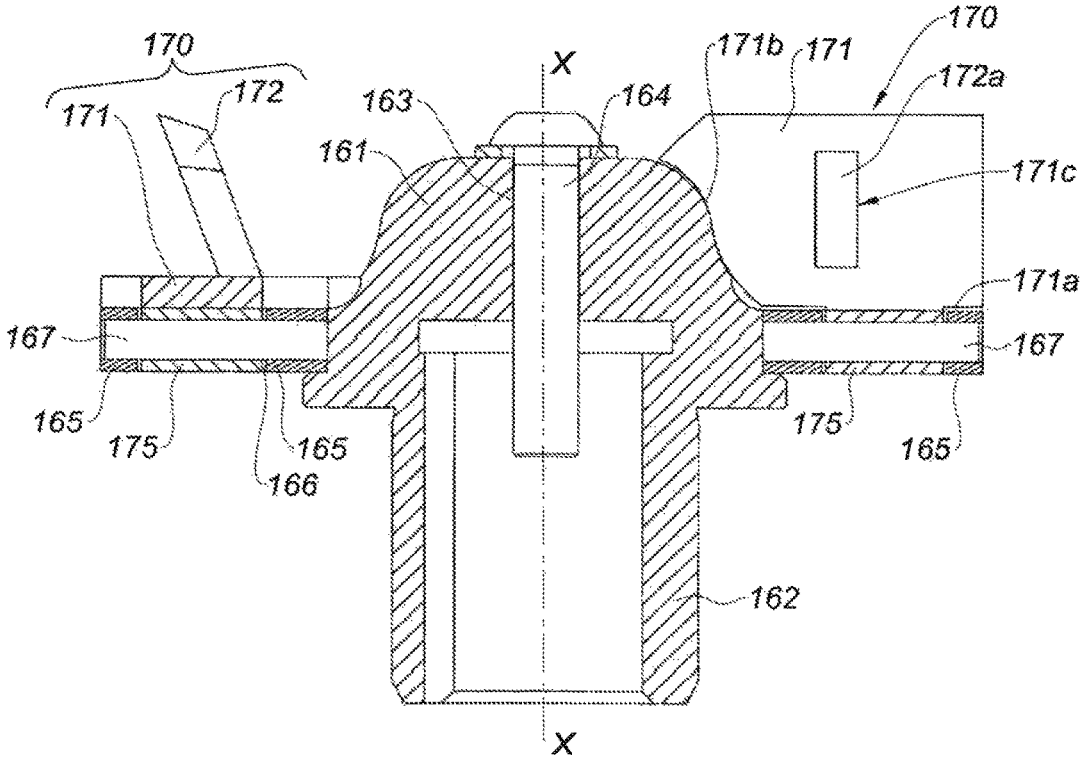
Figure 5A:
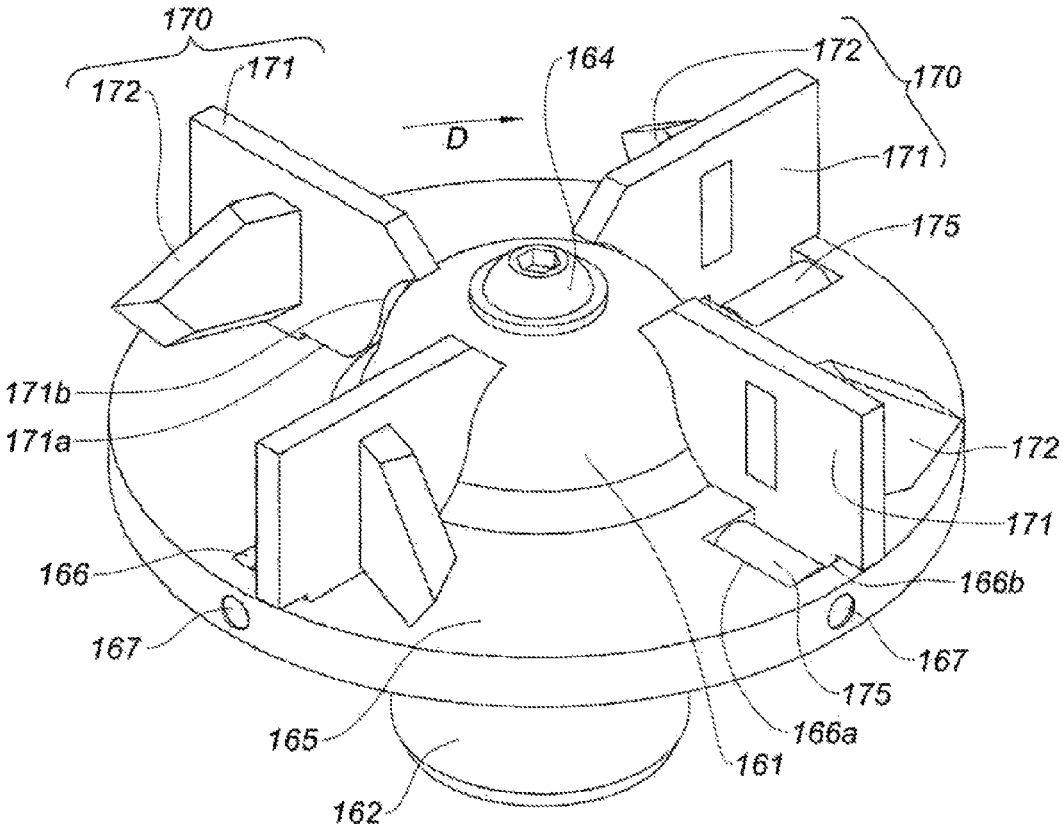
Figure 5B:
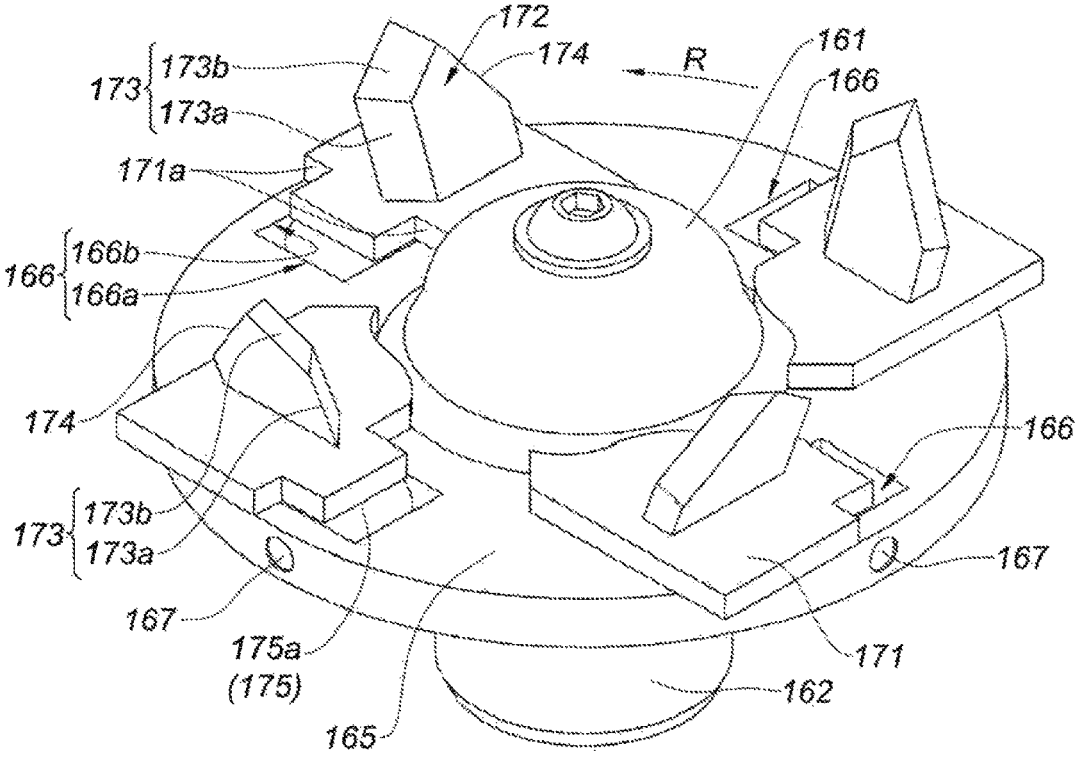

The present invention will be described hereafter in greater detail with the aid of an embodiment of a wastewater pump according to the invention shown in the appended drawings, in which:

FIG. 1 shows an isometric view of an embodiment according to the present invention in the cover of the pump chamber, FIG. 2 shows an axial sectional view of the pump chamber of FIG. 1 and the cover thereof, FIG. 3 shows a sectional view similar to that of FIG. 2, but without the rotor, FIG. 4 shows an axial sectional view of the rotor of the pump in the turned position with respect to that of the preceding figures, FIG. 5A, 5B show schematically and in an isometric view two positions of the blades of the rotor of the pump:

FIG. 5A shows the blades in the active pumping position for the forward direction of rotation direct of the rotor, FIG. 5B shows the turned back position of the blades for the reverse direction of rotation of the rotor.

DESCRIPTION OF ONE EMBODIMENT OF THE INVENTION

According to FIG. 1, the invention relates to a wastewater pump 100 composed of a reversible motor 110, in this case an electric motor not shown in detail. The motor 110 terminates in the lower part according to the orientation of FIG. 1 by a peripheral flange or base 120 bearing the cover 140 of the pump chamber 150 (not shown in this drawing).

The end 111 of the motor shaft 110 bears a rotor 160 formed of a hub 161 with a disc 165 provided with pivoting blades 170 occupying the position shown for the forward direction of rotation D, which is the pumping direction. The rotor 160 with its disc 165 turns within a fixed ring 130 bearing a peripheral cutter 135 with a double cutting edge, of triangular shape with an edge subdivided into a front edge 136*a* and a rear edge 136*b*, each having two cutting edge segments.

According to FIG. 2, the chamber of the pump 150 is closed by a cover 140 fixed to the flange 120 of the motor 110 and surrounding the rotor 160 and the fixed ring 130. The cover 140 has an axial inlet (EA) along the axis xx of the rotor 160 and a tangential outlet (ST) 152 on the periphery of the toric volume 150 in which the rotor 160 turns.

The inlet (EA) 151 of the cover 140 is formed by a sleeve 142 and an internal ring 143, in a plane perpendicular to the axis xx, in order to form the wall of the chamber 150 facing the fixed ring 130 and thus delimiting the toric shape of the chamber in which the rotor 160 turns. The cover 140 terminates with a fixing edge 141 in order to be assembled with the flange 120 of the motor 110.

The shape of the cover 140 and the fixed parts of the pump inside the cover can be seen better in FIG. 3 showing the end 111 of the shaft of the motor on which the rotor 160 (removed here) is fixed, as well as the fixed ring 130 and the internal circular ring 143 of the cover.

According to FIG. 4, the rotor 160 represented in a position which is turned with respect to the position of FIGS. 1 and 2 is composed of a hub 161 with a rounded cross-section which is frustoconical overall followed by a sleeve 162 and having at its centre a drilling 163 for the passage of the screw 164. The sleeve 162 engages on the end 111 of the shaft of the motor 110 and is locked by the screw 164, itself secured by an anti-unscrewing means avoiding unlocking under the effect of the reversal of the direction of rotation of the rotor.

This hub 161 bears a circular disc 165 equipped with four pivoting blades 170, of generally radial orientation, each formed by a plate 171 bearing an articulation node 175 engaged on a radial spindle 167 housed in the thickness of the disc. The spindle 167 passes radially through a rectangular window 166 cut out in the disc 165 in order to receive the articulation node 175, itself offset relative to the plane of the plate 171 on the edge 171*a* thereof. Thus, in the active raised position of the plate 171, the node 175 which is situated at the centre of the edge 171*a* of the plate closes the gap between the plate 171 and the disc 165 and in the pivoted position the node 175 also forms a deflecting slope.

FIG. 4 shows, on the right, the blade 170 in the active position, and on the left, in a position turned back against the disc 165.

The node 175 preferably has a length equal to half of the length of the edge 171*a* of the plate 171 in order to distribute the forces in the best way over the articulation spindle 167 whilst retaining the articulation in the radial direction. The plate 171 of each blade 170 has a front face which is exposed in the forward direction of rotation D and has on the back a soldered cutter 172 forming a prop 172. According to the right-hand part of FIG. 4, the prop 172 preferably has a lug 172*c* of rectangular cross-section accommodated in a rectangular cutout 171 having a shape corresponding to the plate 171 which ensures its retention in addition to the welding in such a way as to give a precise orientation to the prop which functions as a cutter, as shown on the left-hand part of FIG. 4: the prop/cutter 172 is inclined and oriented towards the exterior relative to the plane of the disc 165. This prop 172 supports the plate 171 so that it remains in the raised position for operation of the blade, preferably perpendicular to the plane of the disc 165 when the rotor 160 turns in the forward direction D (FIG. 1 and FIG. 5A) in such a way that the blade 170 gives the liquid a radial pressure without a component following the axis xx for the maximum output of the pump. When the rotor 160 turns in the reverse direction R (FIG. 5B), the plate 171 pivots about its spindle 167 in the plate 165 in order to be turned back and come to lie flat against the disc in such a way that the prop 172 becomes a cutter projecting from the back of the plate 171 (FIG. 5B).

Advantageously, as the pivot spindle 167 and the node 175 of the blade are accommodated in a window 166 in the disc 165, the plate bearing an offset node 175 going into the window, the forces both in the radial direction and in the peripheral direction are absorbed by virtue of the support of the node 175 against the exterior end 166*b* of the window 166 (in the radial direction) and against the "downstream" edge which is the radial edge 166*a* in the downstream position in the forward direction of rotation (D) or the reverse direction of rotation (R), by means of the adapted dimensions of the node 175 and of the window 166. These supports effectively relieve the strain on the articulation spindle 167 in spite of the considerable and powerful forces which may be exerted on the blade 170 and on the cutter 172. The surface 175*a* of the node which is its leading surface, the front face when the rotor 160 turns in the reverse direction (R), is preferably inclined in order to divert the stream of liquid passing over the top of the disc 165 and the plates 171 which are turned back (FIG. 5B). As the blades 170 lie flat or practically flat against the top of the disc 165, they do not drive the liquid in the reverse direction and do not create suction of the liquid in the direction contrary to the direction of pumping. The backflow of liquid for the rotation in the reverse direction of the rotor is negligible.

The prop forming the cutter 172 has a cutting edge 173 which is subdivided, composed of a first segment 173*a* which is relatively straight at the base of the cutter and followed by a second segment which is relatively inclined joining the tip of the cutter. The shape of the cutter 172 benefits from the effectiveness of the cutting edge, principally the first segment 173*a* without the risk of this cutting edge holding back the entrained fibres for too long since these fibres are ejected from the cutter 172 by the second relatively inclined segment 173*b*. The cutter 172 is preferably oriented in the peripheral direction.

Furthermore, in the prop position, the cutter 172 has an effect of unclogging of the rear of the blade 170, avoiding the risk of thread-like products directly enveloping the plate 171 forming the body of the blade. According in particular to FIGS. 1, 4 and 5A, the edge of the plate 171*b*, in the vicinity of the hub 161 of the rotor, follows this contour relatively closely when the plate 171 is in the active blade position.

When the pump turns in the forward direction (D), the thread-like elements in the wastewater can become wound around the blades 170 and remain wound whilst being cut at the periphery by passing over the first edge 136*a* of the fixed cutter 135 (FIG. 1). The mass of fibres thus attached around the blades of the rotor 160 cannot be released solely by the centrifugal force and the fixed cutter 135 at the periphery.

By then reversing the direction of rotation (R), even clogged with thread-like products, the blades 170 tilt progressively around their spindle 167 by reaction to the fluid. The cutters 172 project progressively as the blades 170 incline and cut the thread-like products which clog the blades in co-operation with the cutter fixed at the periphery. This release is quick and makes it possible to free the rotor 160 without causing perceptible over-consumption of current.

LIST OF REFERENCE NUMERALS

| | | | |
|---|---|---|---|
| 100 | pump | | |
| 110 | motor | | |
| | 111 | end of the motor shaft | |
| | 112 | tapping | |
| | 113 | turning joint | |
| 120 | flange/base of the motor | | |
| | 121 | bolt/screw | |
| 130 | fixed ring | | |
| | 135 | fixed cutter | |
| | | 136a | cutting edge |
| | | 136b | cutting edge |
| 140 | cover | | |
| | 141 | fixing edge | |
| | 142 | sleeve | |
| | 143 | inner ring | |
| 150 | pump chamber/toric volume | | |
| | 151 | inlet | |
| | 152 | outlet | |
| 160 | rotor | | |
| | 161 | hub | |
| | 162 | sleeve | |
| | 163 | drilling | |
| | 164 | screw | |
| | 165 | disc | |

-continued

LIST OF REFERENCE NUMERALS

| | | | |
|---|---|---|---|
| | 166 | window | |
| | | 166a | radial edge |
| | | 166b | exterior edge |
| | 167 | spindle | |
| 170 | pivoting blade | | |
| | 171 | plate | |
| | | 171a | edge |
| | | 171b | edge |
| | | 171c | cutout |
| | 172 | cutter/prop | |
| | | 172a | lug |
| | 173 | cutting edge | |
| | | 173a | first segment of the cutting edge |
| | | 173b | second segment of the cutting edge |
| | 174 | rear edge | |
| | 175 | articulation node | |
| | | 175a | inclined leading surface of the node |

EA inlet of the pump chamber
CT outlet of the pump chamber

The invention claimed is:

1. Wastewater pump comprising a reversible motor driving a rotor equipped with blades, housed in a pump chamber with an axial inlet (EA) and tangential outlet (ST), the pump being characterised in that the rotor (160) is a disc (165) bearing blades (170) each mounted on a radial spindle (167) borne by the rotor and pivoting between an active position raised in the forward direction of rotation (D) of the rotor and a position retracted against the disc for the reverse direction (R) of rotation of the rotor, each blade (170) being composed of a plate (171) bearing an articulation node (175) engaged on the spindle and a cutter (172) on the back of the plate forming a prop supporting the plate in the active position when the rotor (160) is rotating in the forward direction (D), and the cutter (172) projecting in the peripheral direction when the rotor (160) turns in the reverse direction (R), the plate (171) being applied against the disc (165), a fixed ring (130) surrounds the plate and carries at least one cutter (135).

2. Wastewater pump according to claim 1, characterised in that the disc (165) of the rotor includes windows (166) each housing an articulation spindle (167) of a plate (171) receiving the articulation node (175) of the plate.

3. Wastewater pump according to claim 2, characterised in that the articulation node (175) extends over the centre of the edge (171*a*) of the plate (171), the node being offset with respect to the plane of the plate so that this latter comes to be flat on the disc (165) when it is in the lowered position.

4. Wastewater pump according to claim 2, characterised in that the node (175) and its window (166) are dimensioned so that in the raised position and in the lowered position the node (175) is supported against the respective downstream edge (166*a*) of the window (166) in the direction of rotation of the rotor (160).

5. Wastewater pump according to claim 2, characterised in that the radial length of the window (166) and of its spindle (167) in the window is equal to the radial length of the node (175), except for the clearance.

6. Wastewater pump according to claim 1, characterised in that the disc (165) includes a hub (161) in relief and the edge of each blade plate (171) follows the profile of the hub (161) when the plate (171) is in the active position.

7. Wastewater pump according to claim 6, characterised in that the hub (161) has a frustoconical shape.

8. Wastewater pump according to claim 1, characterised in that the cutter (172) fixed on the back of the panel (171) of a blade (170) has a subdivided cutting edge (173) forming the cutting edge, with a first edge (173*a*) on the plate side followed by an inclined edge (173*b*) joining the top in the form of a tip of the cutting edge.

* * * * *